United States Patent [19]

Kölblin et al.

[11] Patent Number: 4,989,510

[45] Date of Patent: Feb. 5, 1991

[54] SCREEN PRINTING MACHINE

[75] Inventors: Karl Kölblin, Emmendingen; Peter Geiger, Teningen, both of Fed. Rep. of Germany

[73] Assignee: Werner Thieme GmbH & Co. KG Maschinenfabrik, Fed. Rep. of Germany

[21] Appl. No.: 268,979

[22] Filed: Nov. 9, 1988

[30] Foreign Application Priority Data

Nov. 9, 1987 [DE] Fed. Rep. of Germany ..... 3738038

[51] Int. Cl.[5] ..... B41F 15/00

[52] U.S. Cl. ..... 101/123; 101/127.1

[58] Field of Search ..... 101/114, 123, 129, 126, 101/127.1

[56] References Cited

U.S. PATENT DOCUMENTS

| | | | |
|---|---|---|---|
| 3,659,523 | 5/1972 | Olsen | 101/123 X |
| 4,254,707 | 3/1981 | Lambert et al. | 101/123 |
| 4,854,229 | 8/1989 | Vassiliou | 101/123 |

FOREIGN PATENT DOCUMENTS

| | | |
|---|---|---|
| 0208669 | 1/1987 | European Pat. Off. . |
| 2903415 | 8/1979 | Fed. Rep. of Germany . |
| 2743234 | 5/1985 | Fed. Rep. of Germany . |
| 2365438 | 4/1978 | France . |
| 2013572 | 8/1979 | United Kingdom . |

OTHER PUBLICATIONS

Three pages from the European Patent Office.

*Primary Examiner*—Edgar S. Burr
*Assistant Examiner*—Moshe I. Cohen
*Attorney, Agent, or Firm*—Evenson, Wands, Edwards, Lenahan & McKeown

[57] ABSTRACT

A screen printing machine is disclosed which has a screen frame mounted on a swivel mount shaft. The swivel shaft for the screen frame extends through the center plane of the screen frame which extends perpendicularly with respect to the movement of the squeegee. Devices are provided which can raise the screen frame on both sides of the swivel shaft. By means of this construction, while the advantages of a compensation of errors are maintained, the screen printing machine may be used for movements of the squeegee in both directions. The new screen printing machine is particularly well suited for the printing of printed circuit boards.

13 Claims, 2 Drawing Sheets

SCREEN PRINTING MACHINE

BACKGROUND AND SUMMARY OF THE INVENTION

The invention relates to a screen printing machine having a printing table and a squeegee which is guided reciprocatingly over the printing table in a frame, as well as a screen frame which can be swivelled around a shaft extending perpendicularly with respect to the movement of the squeegee, between the squeegee and the printing table.

In all known screen printing machines, the screen frame, behind the squeegee moving over the screen, must be raised such that the screen detaches from the dye applied to the sheet to be printed. It is disadvantageous that this lifting-off movement can be carried out at only one side of the screen frame. In the case of some printing operations, particularly when printing electric circuit boards, it is often not possible to place the so-called solder resist in the very narrow spaces between adjacent tracks, by means of a squeegee movement in only one direction. These narrow spaces are located on the printed circuit board in raised section resulting from removal of a copper layer by caustics. The spaces existing between the tracks are partly so narrow that they are not filled sufficiently when a squeegee movement takes place in only one direction. A squeegee movement in both directions, however, which in principle is also possible in the case of the known screen printing machines, can be accomplished in only one direction with a perfect lifting-off of the screen from the printed surface.

In this regard, it should be pointed out that, in screen printing, the distance at which the screen is located above the printing table and over which it is pressed downward onto the surface to be printed by the pressure of the squeegee always results in a so-called geometrical printing error which can be compensated at least partially by the one-sided raising of the screen frame behind the passing-through squeegee. It has also been suggested in German Patent (DE-PS No. 27 43 234) to swivel the screen frame upward, during the squeegee movement, not around a swivel shaft located at the end of the squeegee movement directly at the screen frame, but around a shaft located above the screen frame plane and at a distance from the end of the screen frame. Although, by means of this measure, it is possible to partially compensate the geometrically caused printing error and possibly also the printing error caused by the expansion of the network, as in all other known screen printing machines, this is possible only if the squeegee is moved over the screen in one direction.

An object of the invention is therefore to develop a screen printing machine of the initially mentioned type such that it is possible to raise the screen frame for both moving direction so that, in both moving directions, at least partially, a compensation is possible of the printing error occurring during screen printing.

For achieving this object, it is suggested, in the case of a screen printing machine of the initially mentioned type, to place the swivel shaft through the center plane of the screen frame, which extends perpendicularly with respect to the movement of the squeegee, and to provide devices for the raising of the screen frame on both sides of the swivel shaft. As a result of these measures, the screen frame, as a function of the movement of the squeegee, can always be raised such that it is lifted up behind the continuing squeegee. Thus it becomes possible to compensate a printing error even if, for example, during the production of printed circuit boards, printing must take place by means of a double movement of the squeegee in both directions.

This new development also offers the advantage that, as a result of the swivelling movement of the screen frame around its center, the part of the screen frame which is located in front of or behind the swivel shaft—viewed during the movement of the squeegee—carries out different relative motions with respect to the printing table which are opposed to one another. These different relative movements, which result in an opposite shifting of parts of the screen with respect to the printing table, permit, in a particularly simple manner, that the geometrical printing error is compensated which has different preceding signs also over the length of the screen frame. However, at the same time, as a result of the screen printing process, a certain compensation of the length expansion of the screen may be achieved in that the swivel movement of the screen frame does not begin before the movement of the squeegee starts, and therefore larger swivelling angles are not reached before the squeegee has covered a larger distance on the screen. Therefore, by means of the new development, analogously to the increasing screen expansion during the movement of the squeegee, an opposed compensation may be made possible.

In a particularly simple manner, the new device may be implemented in that the swivel shaft is formed by two shaft journals which each project from the screen frame toward the outside and which are each disposed in a link which can be displaced perpendicularly with respect to the printing table. In this case, the link may be laterally guided in a vertical guide rail which is fixedly arranged at the frame. In order to achieve a low-friction guiding, it is advantageous to equip the link with two rollers which each rest laterally against the guide rail. This construction makes it possible to maintain the distance of the screen frame with respect to the printing table in the end area of the movement of the squeegee despite the swivelling movement around the center line. However, the displacement of the screen frame with respect to the printing table according to the invention takes place nevertheless.

With respect to being able to raise the screen frame selectively at both ends, a simple solution can be achieved by providing carriages which each can be displaced in parallel with respect to the longitudinal edge of the screen frame, a lifting slope being assigned to each of them, for controlling movement of lateral guide pins of the screen frame. By means of a relative displacement of the carriages with respect to the screen frame, the guide pins run up against the lifting slopes, and as a result, the screen frame is raised.

In order to, as indicated previously, achieve at the same time that during the lifting movement, the distance of the screen frame with respect to the table surface does not change, it is very advantageous for the lifting slopes to be part of a slot guide in the carriages, which slot guide consists of two slot portions enclosing an obtuse angle, the lengths of these slot portions being the same as measured in a direction parallel to the printing table. In this case, one slot portion may extend in parallel with respect to the printing table so that, during a relative displacement of the carriages, an end area—s-pecifically the end area containing the lateral guide pins—continues to have the same distance from the printing table, and only the remaining screen frame is raised. Expediently, the construction is such in this case that the guide pins, which engage in the slot portion, which extends in parallel with respect to the printing table, are also arranged in the area of the ends of the printing table. Correspondingly, carriages with slot guides are assigned to each of the two ends of the screen frame on both sides, and these slot guides in the carriages assigned to the opposite ends of the screen frame are constructed in mirror symmetry with respect to the center plane of the screen frame. When one end of the screen frame is raised, the other end is guided in parallel with respect to the printing table and vice versa.

For the relative displacement of the carriages with respect to the printing table and the screen frame, it is advantageous and simple to provide a displacing drive for both carriages, which consists of connecting rods connecting both carriages with a pivoted lever, which is pivoted at the frame of the screen printing machine and which can be caused to carry out its reciprocating movement in a controlled manner by means of a drive.

Other objects, advantages and novel features of the present invention will become apparent from the following detailed description of the invention when considered in conjunction with the accompanying drawings.

DETAILED DESCRIPTION OF THE DRAWINGS

Figure 1:
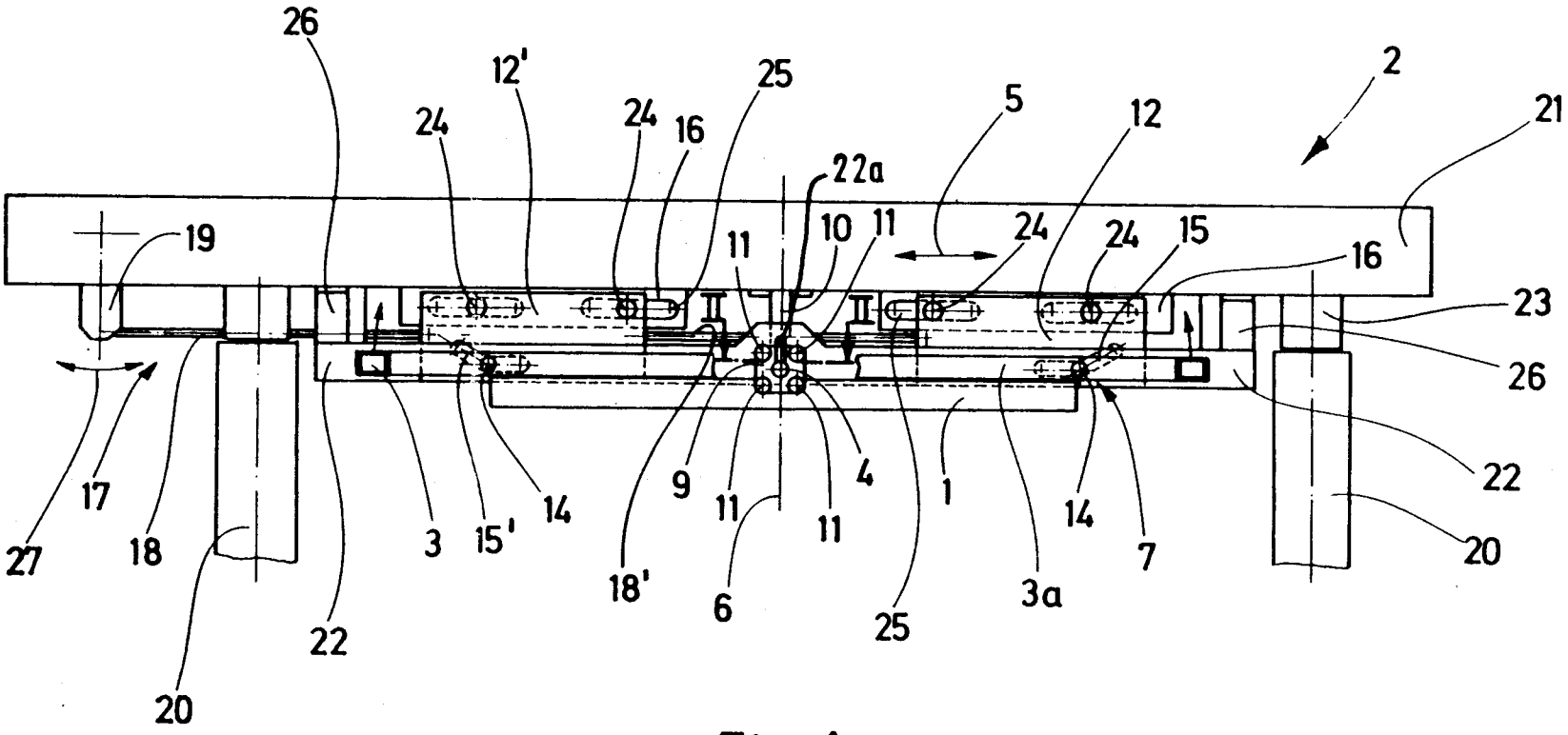
FIG. 1 is a schematic lateral part sectional view of a screen printing machine equipped according to the invention in the position in which the screen frame is not swivelled.

FIG. 1 shows a screen printing machine, the printing table 1 of which is arranged inside a machine frame 2 in a manner which is not shown in detail. The machine frame 2 consists essentially of a basic frame with supports 20, which can be placed on the floor and in which guiding columns 23 are held, with which two squeegee guiding bars 21 are connected which extend in parallel to one another. Between these squeegee guiding bars 21, a squeegee, which is not shown, can be reciprocated in the direction of the Arrows 5 in parallel to the printing table 1. At the frame 2, a guide 26 is also fixedly arranged, and lift-out rails 22 are provided which are guided at this guide 26, a screen frame 3 with a not shown printing screen being held between these lift-out rails 22.

Figure 2:
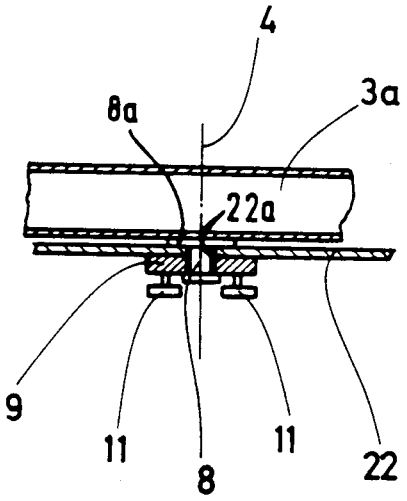
FIG. 2 is an enlarged partial sectional view taken along Line II—II in FIG. 1.

The screen frame 3, as shown particularly in FIG. 2 showing a longitudinal side 3*a* of frame 3, is equipped with a swivel shaft 4 which extends through the center plane 6 of the screen frame 3 and perpendicularly with respect to the squeegee movement 5. This swivel shaft 4 is formed by two shaft journals 8 which are fastened at the lift-out rails 22 by means of a flange 8*a* and project to the outside in the area of the opposite longitudinal sides 3*a* of the swivel frame 3, only one of these shaft journals 8 being shown in FIG. 2. These shaft journals 8 are rotationally supported in a link 9, which, in turn, is guided at a guide rail 10 so that it can be displaced in the direction of the center plane 6, i.e., perpendicularly with respect to the printing table 1. This guide rail 10 is fixedly arranged at the frame 2 of the screen printing machine. In the embodiment shown, guide rail 10 is fixedly arranged at one of the respective squeegee guiding bars 21.

The link 9 is equipped with four rollers 11 projecting toward the outside, of which two rollers respectively place themselves on the left and on the right against the outer edges of the guide rail 10 and thus ensure the perpendicular guidance of the link 9 and thus of the swivel shaft 4 of the screen frame 3. In the lift-out rail 22, in which the screen frame 3 is disposed, a slot-shaped recess 22*a* is provided in the area of the shaft journals 8, this recess 22*a* extending perpendicularly with respect to the screen frame 3 and allowing the adjusting of the shaft journals 8 and of the link 9 with respect to height. As a result, the height of the swivel shaft 4 can be changed with respect to the screen frame 3.

Respective plate-type carriage guides 16 are fixedly provided at the opposed squeegee guiding bars 21. These carriage guides 16 are arranged in the area of the ends of the printing table 1 on both sides located in the direction of the squeegee movement 5. These carriage guides 16 are each equipped with slot-shaped longitudinal guides 25, which each extend in parallel with respect to the printing table 1. Slide pins 24, in each case, engage in both of these slot-shaped longitudinal guides 25. These slide pins 24 are fixedly connected with plate-type carriages 12, 12'. In this manner, the carriages 12, 12' can be displaced in parallel with respect to the printing table 1. Carriages 12, 12' are connected with one another by means of a connecting rod 18' and, by means of an additional connecting rod 18, are connected with a pivoted lever 19, which is pivoted at the frame 2 or in each case at the squeegee guiding bar 21. In a manner which is not shown in detail pivoted lever 19 is connected with a swivel drive which selectively permits a swivelling of the lever in the direction of the arrows 27.

Figure 3:
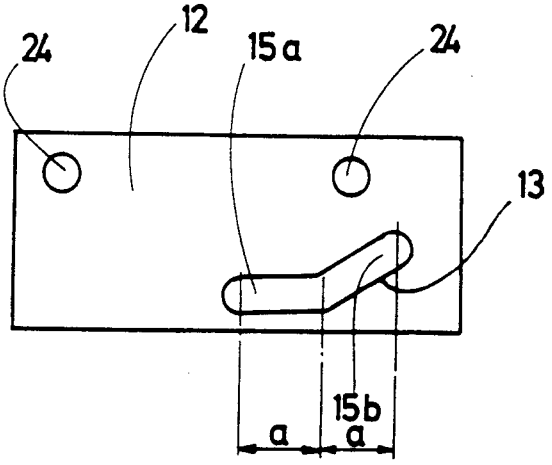
FIG. 3 is an enlarged detail view of one of the two carriages which are guided displaceably with respect to the machine frame.

As shown in FIG. 3, one slot guide 15 respectively is provided in the carriages 12, 12', which slot guide 15 consists of two slot portions 15*a*, 15*b*, which are sloped with respect to one another at an obtuse angle. Slot portion 15*a*, in this case, is developed to extend in parallel with respect to the surface of the printing table 1. Slot portion 15*b* rises diagonally toward the outside relative to the printing table 1 and forms a lifting slope 13 which will be discussed later. Measured in parallel with respect to the printing table 1, the two slot portions 15*a*, 15*b* have the same length "a".

As shown in FIG. 1, the slot guides 15, 15' of the two carriages 12, 12', which in each case are assigned to the areas of the ends of the printing table 1, have an identical construction which, however, is arranged to be mirror-inverted with respect to the center plane 6. Guide pins 14 engage in both slot guides 15, 15'. The guide pins 14 are fixedly arranged at the lift-out rails 22 at which the screen frame 3 is held, in the area of the ends of the printing table 1. By means of a relative displacement of the carriages 12, 12' with respect to the frame 2, a swivel movement of the screen frame 3 is therefore caused around the swivel shaft 4. In this case, when the carriage 12, 12', is moved from the shown position, in FIG. 1 toward the left, the right side of the screen frame 3 is raised, and the area of the screen frame 3, which at the left end of the printing table 1 is held by means of the guide pins 14, although it does not change its distance with respect to the printing table, does change its relative position to the printing table.

Figure 4:
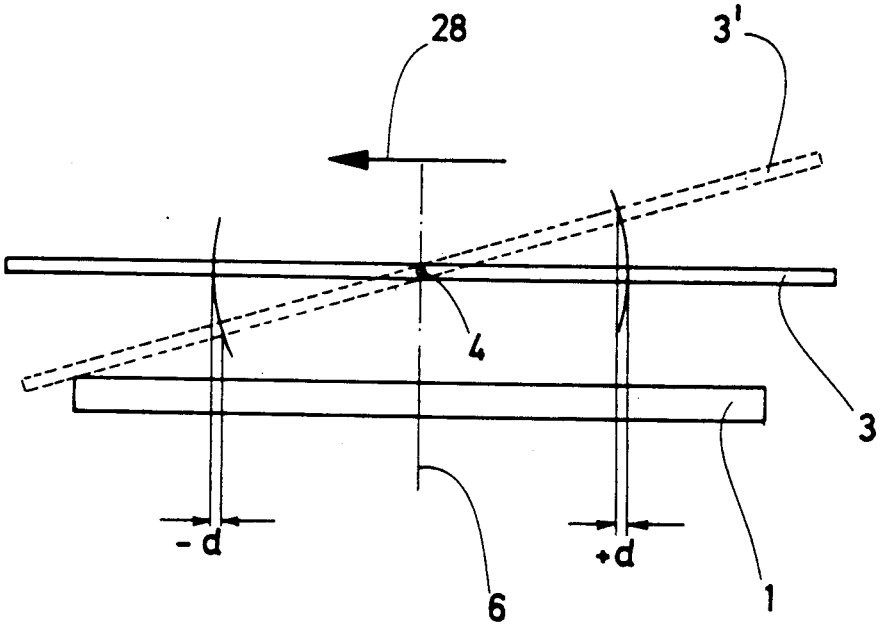
FIG. 4 is a schematic representation of the circumstances which occur when the screen frame is swivelled.

This relative position of the screen 3 and printing table 1 is shown in detail in the schematic FIG. 4, where the conditions are shown of the relative position of the screen frame 3 with respect to the printing table 1 when the screen frame 3 is swivelled counterclockwise, and how this movement takes place, in the case of a movement of the squeegee in the direction of the Arrow 28. When the frame 3 is swivelled around the swivel shaft 4, which is arranged in the central plane 6 of the screen frame 3, the frame portions which are located on the right of the swivel shaft 4 and which are swivelled into position 3', are displaced in the direction of the Arrow 28 by the amount (+d) in their relative position with respect to the printing table 1, when the screen is pressed against the surface of the printing table 1 by means of the squeegee during the printing operation. On the other hand, the portions of the screen frame 3, which are located on the left of the swivel shaft, are displaced by the amount (−d) against the direction of the Arrow 28 relative to the printing table 1. Since it is known that, during screen printing, the geometrical error, as a result of the distance of the screen frame 3 from the printing table surface, even though it is slight, and as a result of the pressing-down by means of the squeegee, also has the corresponding effect with respect to the center plane 6, but one that is opposite to the displacements (a) according to FIG. 4, it becomes clear that, by means of the development according to the invention, a very simple, but effective method is created in order to compensate the geometrical error during screen printing. For this purpose, no complicated movement of the screen frame is required. The swivelling around the swivel shaft 4 is sufficient.

It is also known that, as a result of the pressure of the squeegee on the screen and by means of the resulting expansion of the screen, an additional printing error occurs which depends on the elasticity characteristics of the screen and on the pressure of the squeegee, and which, with an increasing movement of the squeegee, in the case of FIG. 4, therefore with an increasing movement of the squeegee in the direction of the Arrow 28, becomes increasingly larger. The swivelling movement of the screen frame 3 according to the invention counteracts also this error, if the swivelling angle is selected to be correspondingly large. A certain compensation of the fact that this screen expansion error is smaller at the start of the squeegee movement, in the case of the device according to the invention, is achieved by the fact that the swivelling movement of the screen frame 3 is not initiated before the start of the movement of the squeegee so that the swivelling angle, which is covered by the screen frame 3, also becomes larger with an increasing movement of the squeegee in the direction of the Arrow 28. The displacement of the screen portions in the direction of the Arrow 28 will therefore at first, at the beginning of the squeegee movement, be very small, and will become larger only as the path of the squeegee increases. This results in a qualitative compensation of the screen expansion.

It should be pointed out that also, by means of the parallel guidance of the guide pins 14 of the screen frame 3, no other relationships occur in regard to the position of the screen frame 3 with respect to the printing table 1, than those shown in FIG. 4. By means of the guidance of the perpendicular center plane 6, when the screen frame 3 is swivelled, a longitudinal displacement of the guide pins will also always occur with respect to the printing table 1, which is made possible by the slot portions 15*a* of the slot guides 15 in the two carriages 12, 12'.

As can be recognized very easily, by means of the screen printing machine according to the invention, a clockwise swivelling movement of the screen frame 3 may also be achieved if, for example, printing is to take place by means of a squeegee movement opposite to the Arrow 28 of FIG. 4. The relationships will then be the same, but with reversed preceding signs. The new screen printing machine may therefore be used for screen printing in two different squeegee directions, without any giving-up of the advantages of the raising of the screen frame behind the squeegee and of the advantages of a certain compensation of errors.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A screen printing machine comprising:

a printing table, a squeegee holder, a squeegee holder support frame for guiding movement of the squeegee holder over the printing table, a screen frame disposed between the squeegee holder and printing table, a screen frame support means for supporting the screen frame, said screen frame support means including a central pivot support for controlling pivotal movement of the screen frame about a central pivot axis and a pair of screen frame raising devices disposed at respective opposite lateral sides of the central pivot support adjacent respective longitudinal edges of the screen frame, wherein said screen frame raising devices each include a movable carriage which is displaceable in a direction parallel with an adjacent longitudinal edge of the screen frame, said movable carriage and said adjacent longitudinal edge of the screen frame including interengageable guide pin means and guide slot means for positively controlling raising movement of the longitudinal edge of the screen frame in response to movement of said carriage, and wherein said guide slot means includes two slot portions which enclose an obtuse angle.

2. A screen printing machine according to claim 1, wherein the guide pin means and guide slot means of the two screen frame raising devices are configured to be symmetrically configured with respect tot he central pivot axis.

3. A screen printing machine according to claim 1, wherein the guide pin means and guide slot means includes guide pin means fixed to the longitudinal edge of the screen frame and guide slot means in said movable carriage.

4. A screen printing machine according to claim 2, wherein the guide pin means and guide slot means includes guide pin means fixed to the longitudinal edge of the screen frame and guide slot means in said movable carriage.

5. A screen printing machine according to claim 1, wherein the central pivot support is formed by two shaft journals which each project toward the outside from the screen frame, and wherein the shaft journals are each disposed in a perpendicularly displaceable link.

6. A screen printing machine according to claim 5, wherein the link is guided laterally at a vertical guide rail which is arranged fixedly at the squeegee holder support frame.

7. A screen printing machine according to claim 6, wherein the link is equipped with two rollers respectively which rests laterally against the guide rail.

8. A screen printing machine according to claim 1, wherein the respective screen frame raising devices are arranged in the areas of the respective end edges of the printing table.

9. A screen printing machine according to claim 8, wherein the carriages are guided at respective guides of the squeegee holder support frame and are connected with a displacing drive which operates in the same travel direction as the squeegee holder support frame.

10. A screen printing machine according to claim 9, wherein the displacing drive comprises connecting rods which connect both carriages with a reciprocally movable drive.

11. A screen printing machine according to claim 10, wherein the drive includes a pivoted lever which is disposed at the squeegee holder support frame and is connected with a driving mechanism.

12. A screen printing machine according to claim 1, wherein a first of the slot portion extends parallel with the plane of the printing table and the second of the slot portions extends upwardly with respect to said plane.

13. A screen printing machine according to claim 12, wherein both of said slot portions have the same length in a direction parallel with the plane of the printing table.

* * * * *